US008944628B2

(12) United States Patent
Melamed

(10) Patent No.: US 8,944,628 B2
(45) Date of Patent: Feb. 3, 2015

(54) TRANSFERRABLE PURSE ORGANIZER WITH INTERIOR LIGHTING SYSTEM

(75) Inventor: Hardeep Melamed, Atlanta, GA (US)

(73) Assignee: PurseN, LLC, Atlanta, GA (US)

( * ) Notice: Subject to any disclaimer, the term of this patent is extended or adjusted under 35 U.S.C. 154(b) by 187 days.

(21) Appl. No.: 13/527,182

(22) Filed: Jun. 19, 2012

(65) Prior Publication Data

US 2013/0201666 A1 Aug. 8, 2013

Related U.S. Application Data

(60) Provisional application No. 61/596,391, filed on Feb. 8, 2012.

(51) Int. Cl.
*A45C 15/06* (2006.01)
*F21L 4/02* (2006.01)

(52) U.S. Cl.
CPC ..... *A45C 15/06* (2013.01); *F21L 4/027* (2013.01); *Y10S 362/802* (2013.01)
USPC ..... 362/156; 362/158; 362/276; 362/802

(58) Field of Classification Search
CPC ..... A45C 3/08; A45C 15/06; F21L 4/027; F21V 33/0004; H05B 37/0281
USPC ..... 362/156, 276, 295, 802, 158; 150/106
See application file for complete search history.

(56) References Cited

U.S. PATENT DOCUMENTS 6,637,909 B1 * 10/2003 Bryan ..... 362/156
2003/0090895 A1 * 5/2003 Guerrieri ..... 362/156

* cited by examiner

*Primary Examiner* — Stephen F Husar
(74) *Attorney, Agent, or Firm* — Robert M. Downey, P.A.

(57) ABSTRACT

A lighting system for illuminating the interior of a container, such as a purse, includes a light strip having multiple lights, a battery to power the lights, an ON/OFF switch to operate the lights, and a timer set to a predetermined time. Pressing the ON/OFF switch a first time activates the lights and starts the timer. Pressing the ON/OFF switch a second time while the timer is still activated will deactivate the lights. If the predetermined time elapses and the ON/OFF switch is not pressed a second time, the lights will deactivate automatically. The lighting strip is covered in a PVC protective coating and encased in a fabric encasement to match the interior of the container. The fabric encasement is stitched or otherwise fixedly attached to the interior of the container adjacent to the top opening of the container.

11 Claims, 5 Drawing Sheets

TRANSFERRABLE PURSE ORGANIZER WITH INTERIOR LIGHTING SYSTEM

BACKGROUND OF THE INVENTION

This non-provisional patent application is based on U.S. provisional patent application Ser. No. 61/596,391 filed Feb. 8, 2012.

FIELD OF THE INVENTION

The present invention relates to purses and handbags and, more particularly, purses and handbags that include a lighting system for providing lighted access to the interior contents of the purse.

DISCUSSION OF THE RELATED ART

Items stored in portable receptacles, such as purses or handbags, can often be difficult to find or retrieve in dark environments, such as within a movie theater or a dark restaurant. This problem is particularly troubling when many items are stored in a purse or handbag, which is often the case. The absence of a good light source causes the purse's owner to need to feel around for the desired item. Certain items, such as a small cell phone, are notoriously always difficult to find in a congested interior of a purse.

Considering these problems, there is a need for an interior lighting system for purses and purse organizer inserts, and for a method to quickly install the lighting system in existing purses.

While certain aspects of conventional technologies have been discussed and presented to facilitate disclosure of some embodiments, Applicant in no way disclaim these technical aspects, and it is contemplated that the attached claims may encompass one or more of the conventional technical aspects discussed herein.

In this specification where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is it known to be relevant to an attempt to solve any problem with which this specification is concerned.

SUMMARY OF THE INVENTION

Some embodiments may address one or more of the problems and deficiencies discussed above. However, it is contemplated that some embodiments may prove useful in addressing other problems and deficiencies in a number of technical areas. Therefore the claims should not necessarily be construed as limited to addressing any of the particular problems or deficiencies discussed herein.

Some embodiments may include a lighting system for illuminating the interior of a portable receptacle, such as a purse, that includes a light strip having multiple lights, a battery to power the lights, an ON/OFF switch to operate the lights, and a timer set to a predetermined time. Pressing the ON/OFF switch a first time activates the lights and starts the timer. Pressing the ON/OFF switch a second time while the timer is still activated will deactivate the lights. If the predetermined time elapses and the ON/OFF switch is not pressed a second time, the lights will deactivate automatically. The lighting strip is covered in a PVC protective coating and encased in a fabric encasement to match the interior of the receptacle. The fabric encasement is stitched or otherwise fixedly attached to the interior of the receptacle adjacent to the top opening of the receptacle.

An advantage provided by certain embodiments is that the contents of a portable receptacle, such as a purse, may be more easily seen and retrieved, particularly in dark environments such as within a movie theater, using the interior lighting system.

These and other advantages of some embodiments are more readily apparent with reference to the detailed description and accompanying drawings.

BRIEF DESCRIPTION OF THE DRAWINGS

For a fuller understanding of the nature of some embodiments, reference should be made to the following detailed description taken in conjunction with the accompanying drawings in which.

Like reference numerals refer to like parts throughout the several views of the drawings.

DETAILED DESCRIPTION OF SOME EMBODIMENTS

Figure 1:
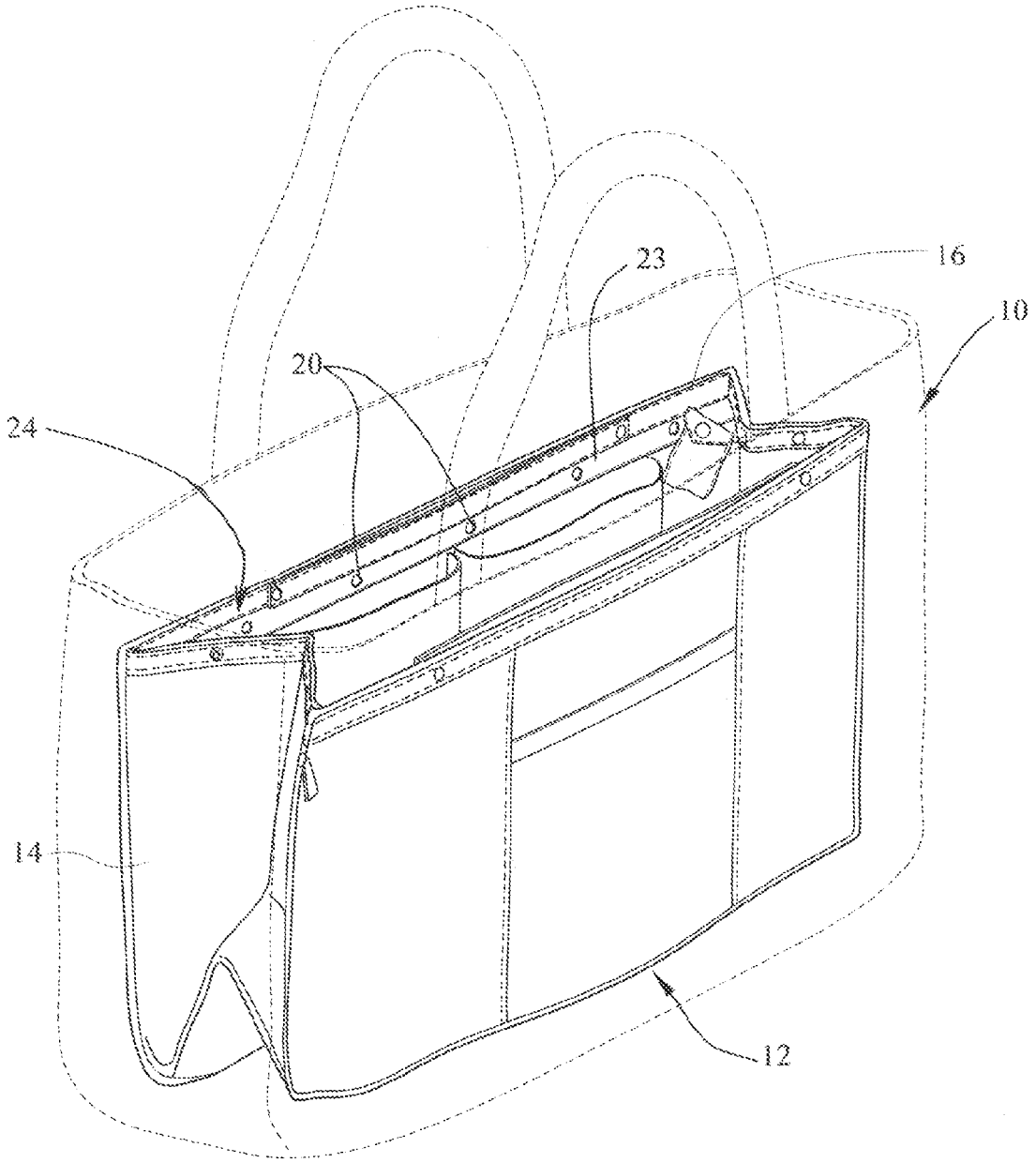
FIG. 1 is a perspective view showing the transferrable purse organizer operatively positioned within a purse or handbag according to one or more of the embodiments of the invention.

The terms "container" "purse" "bag" and "handbag" as used herein are defined as "an object that can be used to hold or transport something" in their broadest sense, and may, in some embodiments, refer to "a small bag used especially by a woman to carry everyday personal items." It must be understood that, while in one embodiment or some embodiments or all embodiments, a "purse" or "handbag", for example, may be referred to, the application of those embodiments for use in other types of container besides purses or handbags is envisioned under this document.

The terms "organizer" and "insert" (when "insert" is used as a noun) are defined as "a portable receptacle for holding or transporting at least one item, wherein the receptacle is intended to be inserted into another receptacle, purse, bag or handbag."

Unless otherwise defined, all terms, and especially any technical and/or scientific terms, used herein may be taken to have the same meaning as commonly understood by one having an ordinary skill in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms such as but not limited to "a first embodiment," "a further embodiment," "an alternate embodiment," "one embodiment," "an embodiment," "multiple embodiments," "some embodiments," "other embodiments," or variants thereof do NOT necessarily refer to the same embodiments. For example, language such as "some embodiments include a feature" followed by "some embodiments include an element" does NOT necessarily admit that both of the feature and the element are included in all of the same embodiments.

Unless otherwise specified, one or more particular features and/or elements described in connection with one or more embodiments may be found in one embodiment, or may be found in more than one embodiment, or may be found in all embodiments, or may be found in no embodiments.

Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any and all details set forth herein are used in the context of some embodiments and therefore should NOT be necessarily taken as limiting factors to the attached claims. Any descriptions of elements and/or features and/or the materials used to create those elements or features, or examples or methods included in the descriptions of the various embodiments are nonlimiting and are given as an illustration only. Accordingly, the embodiments can be manufactured, distributed, used, practiced, and carried out in numerous ways.

The attached claims and their legal equivalents can be realized in the context of embodiments other than the ones used as illustrative examples in the description herein.

Referring to the several views of the drawings, the purse organizer is shown in accordance with some embodiments. In each of these embodiments, the purse organizer is generally indicated as 10.

Reference is now made to FIG. 1. The basic structure of the purse organizer 10 is shown. In this particular figure, the purse organizer 10 is sized for insertion within a larger bag or purse P. Purse organizer 10 includes a bottom surface 12, at least one side surface 14, and at least one top edge 16. Top edge 16 is adjacent to the top opening of the container. The transferrable purse organizer 10 includes lights 20 connected through wiring 22. The lights 20 and wiring 22 are collectively defined as the light strip 24. In a preferred embodiment, the lights 20 are light emitting diodes (LEDs). The exterior surface of the light strip 24 is preferably enclosed by a fabric encasement 23 that matches the interior fabric of the purse. The lights 20 remain exposed through holes on the fabric encasement 23.

Figure 2:
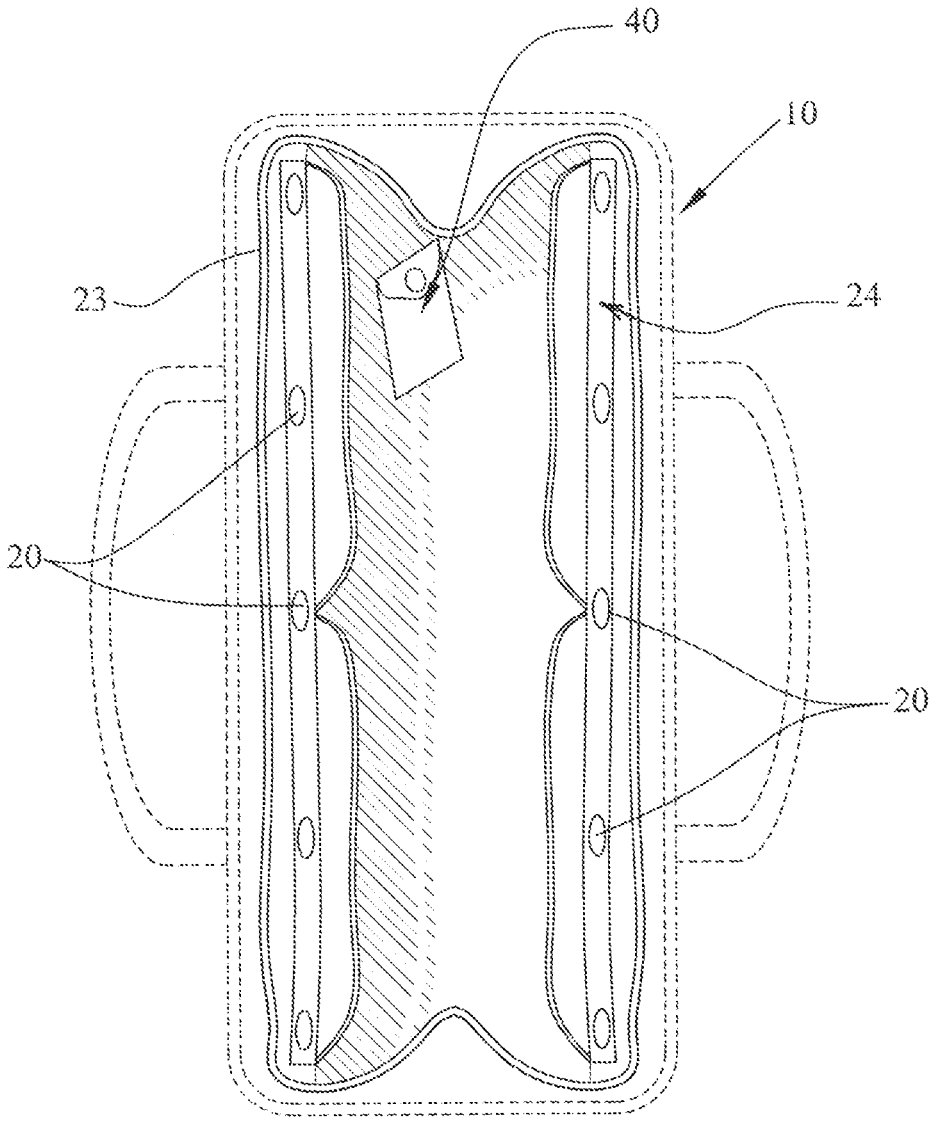
FIG. 2 is a top plan view of the transferrable purse organizer.
Figure 3:
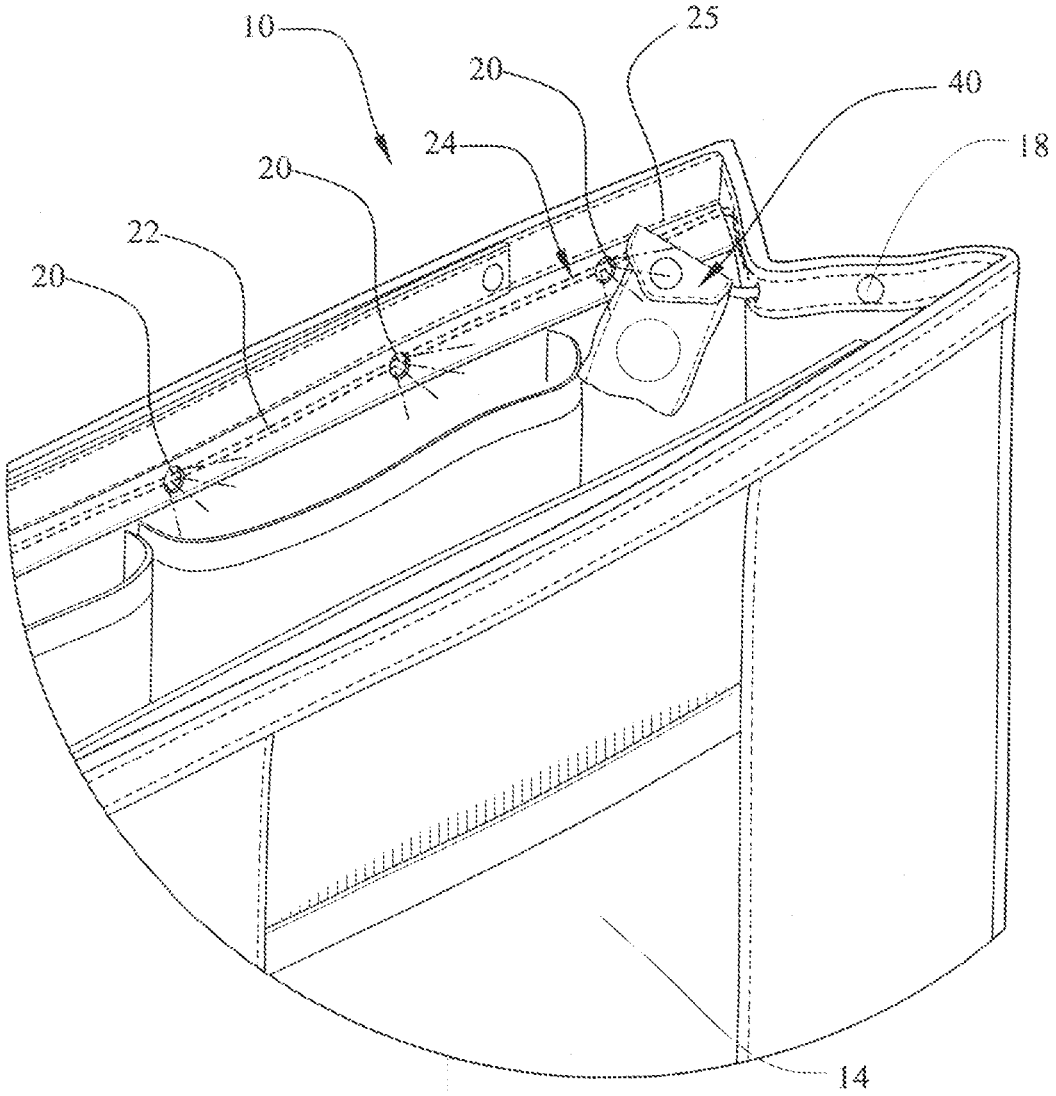
FIG. 3 is a partial perspective view of the transferrable purse organizer according to one embodiment of the invention.
Figure 4:
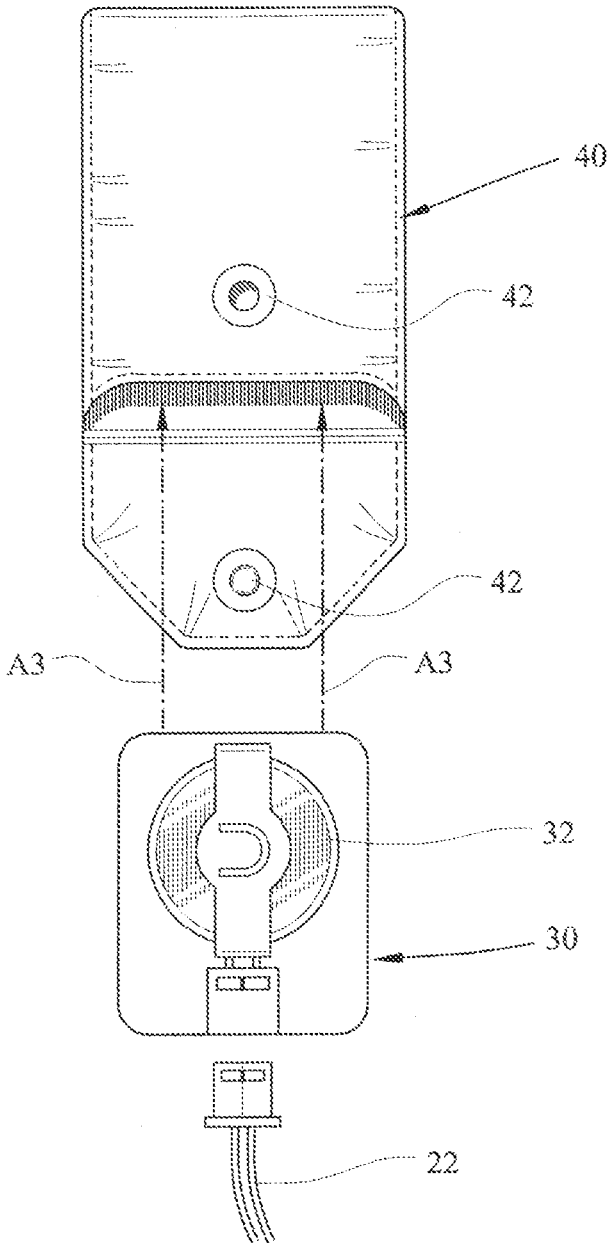
FIG. 4 is a top plan view of the battery and ON/OFF switch control panel being inserted into a pouch according to one embodiment of the invention.

Additional reference is now made to FIGS. 2 and 3. The light strip 24 may include a waterproof protective coating 25 for preventing water from damaging the lights 20 and wiring 22. In a preferred embodiment, the waterproof protective coating 25 is a protective PVC coating. Wiring 22 connects the lights 20 to the control panel 30. The control panel pouch 40 includes the control panel 30 that includes at least one battery 32, the ON/OFF switch 34, and a timer 36 (as shown in FIGS. 3 and 4). At least one side surface 14 may include a plurality of snap buttons 18 that, if connected together, help shrink the size of the organizer 10 for fitting into more compact spaces.

Additional reference is now made to FIG. 4. The control panel 30 connects to the wiring 22. The control panel 30 includes at least one battery 32 for powering the lights 20. The at least one battery 32 is replaceable and may be a rechargeable battery. Arrows A3 show how the control panel 30 may be inserted into a control panel pouch 40. The control panel pouch 40 may be constructed from fabric with a pattern that resembles the interior and/or exterior of the purse organizer 10. The control panel pouch 40 may include snap buttons 42 to help lock in the control panel 30 into the interior space of the pouch 40.

Figure 5:
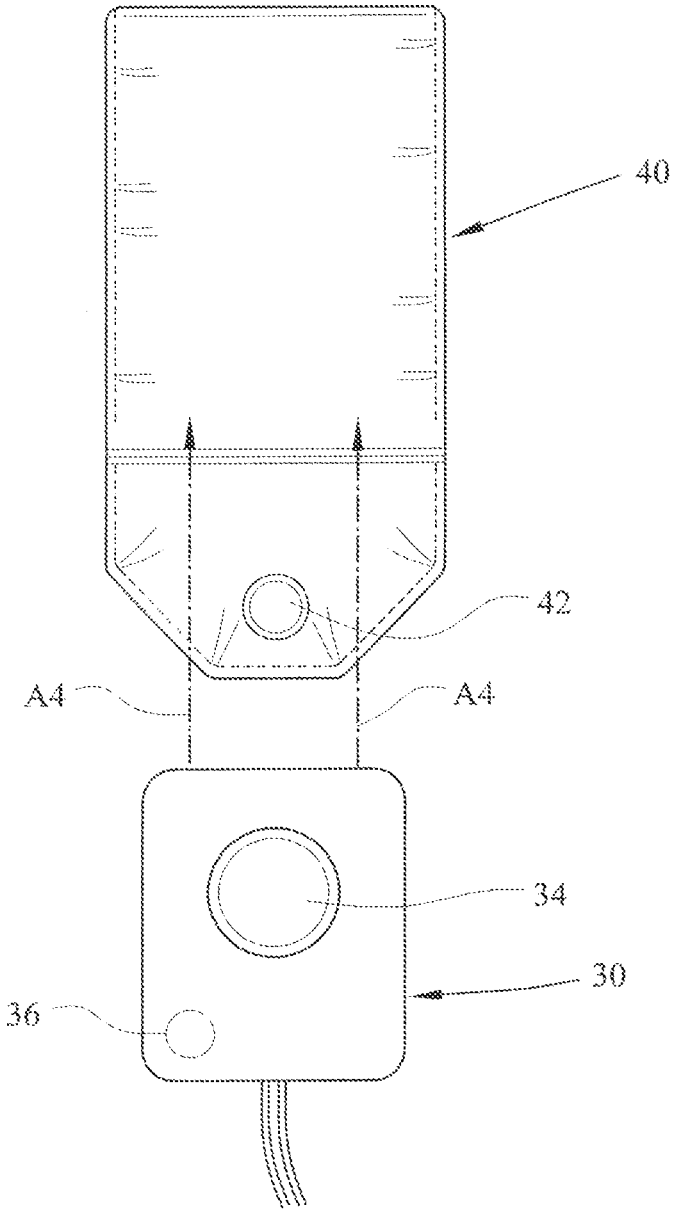
FIG. 5 is a bottom plan view of the battery and ON/OFF switch control panel and pouch of FIG. 4.

Additional reference is now made to FIG. 5. The control panel 30 further includes an ON/OFF switch 34 and a timer 36. Arrows A4 are similar to arrows A3 from FIG. 3 and illustrate how the control panel 30 may be inserted into the control panel pouch 40.

When turned ON, the location of light strip 24 on the interior portion of the top opening of the purse 10 allows a user to have lighted access to the interior contents of the purse 10 with both hands. When ON or OFF, the location of the light strip 24 and control panel pouch 40 do not obstruct access to the interior contents of the purse 10.

Throughout the detailed description and the accompanying drawings enclosed herein, some embodiments have been shown, described and detailed, wherein a variety of possible elements and/or features may be formed and configured in different ways. Accordingly, any and all possible combinations of the elements and/or features described in accordance with these various embodiments may be desirable to manufacturers and/or may help to more successfully meet customers' specific needs and/or preferences. Consequently, any and all possible combinations of the features or elements of one embodiment or more than one embodiment or all embodiments mentioned herein are fully considered within the spirit and scope of the attached claims and their legal equivalents.

Thus, some embodiments of a transferrable purse organizer with an interior lighting system have been disclosed. Other embodiments are contemplated and envisioned, and therefore it is recognized that departures from the embodiments described in this disclosure may certainly exist within the spirit and scope of the attached claims and their legal equivalents. Those having an ordinary skill in the will envision other possible variations and modifications to features and/or elements of the embodiments, and they will envision other possible embodiments, all of which may fall within the spirit and scope of the attached claims. The spirit and scope of the attached claims is therefore NOT limited by the descriptions and illuminations of the embodiments that have already been presented, but rather the spirit and scope can only be defined by the attached claims and their legal equivalents as interpreted under the doctrine of equivalents. Variations, alternatives, adjustments, modifications, tunings, and deviations from the embodiments of the instant disclosure are fully contemplated and envisioned within the spirit and scope of the attached claims.

What is claimed is:

1. A lighting system for the interior of a portable receptacle comprising:

at least one light strip, wherein said light strip includes a plurality of lights;

a battery for powering the plurality of lights, and said battery being replaceable;

an ON/OFF switch, wherein operating the ON/OFF switch causes the plurality of lights to turn ON;

a timer that is started by the ON/OFF switch being operated to turn the lights ON, and wherein the timer causes the lights to turn OFF after a predetermined time has elapsed;

wherein the plurality of lights on said light strip are in wired connection with the timer, ON/OFF switch, and battery;

wherein operating said ON/OFF switch before the predetermined time on the timer has elapsed disables the timer and causes the plurality of lights to be turned OFF; and wherein the light strip and the wiring of the light strip are encased in a waterproof protective coating.

2. The lighting system as recited in claim 1 wherein the waterproof protective coating is a protective PVC coating.

3. The lighting system as recited in claim 1 wherein the coated light strip is covered in a fabric encasement designed to match the interior of the portable receptacle and wherein the fabric encasement includes a plurality of holes each sized to receive one of the plurality of lights therethrough.

4. The lighting system as recited in claim 3 wherein the fabric encasement is attached to the interior of the portable receptacle adjacent to the top opening of the container.

5. The lighting system as recited in claim 1 wherein the lights on said light strip are LEDs.

6. A transferrable purse organizer with an interior lighting system comprising:

an organizer adapted for insertion into a purse, wherein the organizer includes a bottom end and sidewalls surrounding an interior chamber and said sidewalls extending upwardly from said bottom end to an open top end communicating with the interior chamber, and wherein the interior chamber comprises a central storage area and at least one pocket;

at least one light strip, wherein said light strip includes a plurality of lights;

a battery for powering the plurality of lights, and said battery being replaceable;

an ON/OFF switch, wherein operating the ON/OFF switch causes the plurality of lights to turn ON;

a timer that is started by the ON/OFF switch being operated to turn the lights ON, and wherein the timer causes the lights to turn OFF after a predetermined time has elapsed;

wherein the plurality of lights on said light strip are in wired connection with the timer, ON/OFF switch, and battery;

wherein operating said ON/OFF switch before the predetermined time on the timer has elapsed disables the timer and causes the plurality of lights to be turned OFF; and wherein the light strip and the wiring are encased in a waterproof protective coating.

7. The transferrable purse organizer with an interior lighting system as recited in claim 6 wherein the waterproof protective coating is a protective PVC coating.

8. The transferrable purse organizer with an interior lighting system as recited in claim 6 wherein the coated light strip is covered in a fabric encasement designed to match the interior chamber of the organizer and wherein the fabric encasement includes a plurality of holes each sized to receive one of the plurality of lights therethrough.

9. The transferrable purse organizer with an interior lighting system as recited in claim 8 wherein the fabric encasement is attached to the interior chamber of the organizer adjacent to the top opening of the organizer.

10. The transferrable purse organizer with an interior lighting system as recited in claim 6 wherein the lights on said light strip are LEDs.

11. A purse with an interior lighting system comprising:

a purse including bottom end and sidewalls surrounding an interior chamber and said sidewalls extending upwardly from said bottom end to an open top end communicating with the interior chamber, and wherein the interior chamber comprises a central storage area and at least one pocket;

at least one light strip, wherein said light strip includes a plurality of LED lights structured and disposed for directing light into the interior chamber of said purse;

a battery for powering the plurality of lights, and said battery being replaceable;

an ON/OFF switch, wherein pressing the ON/OFF switch causes the plurality of lights to turn ON;

a timer that is started by the ON/OFF switch being pressed to turn the lights ON, and wherein the timer causes the lights to turn OFF after a predetermined time has elapsed;

wherein the plurality of lights on said light strip are in wired connection with the timer, ON/OFF switch, and battery;

wherein pressing said ON/OFF switch before the predetermined time on the timer has elapsed disables the timer and causes the plurality of lights to be turned OFF;

wherein the at least one light strip and the wiring of the at least one light strip are encased in a waterproof protective PVC coating; and wherein the coated light strip is covered in a fabric encasement designed to match the interior chamber of the purse and wherein the fabric encasement includes a plurality of holes each sized to receive one of the plurality of lights therethrough, and the fabric encasement is attached to the interior chamber of the purse adjacent to the top opening of the purse.

* * * * *